US005358422A

United States Patent [19]

Schaffer et al.

[11] Patent Number: 5,358,422

[45] Date of Patent: Oct. 25, 1994

[54] TERMINAL ASSEMBLY

[75] Inventors: David M. Schaffer, deceased, late of Jupiter, Fla.; by Steven R. Schaffer, Personal Representative; Robert J. Flowers, of Jupiter, Fla.

[73] Assignee: Marquette Electronics, Inc., Milwaukee, Wis.

[21] Appl. No.: 16,722

[22] Filed: Feb. 11, 1993

[51] Int. Cl.[5] ..... H01R 13/62

[52] U.S. Cl. ..... 439/346; 439/372; H01R/13/62

[58] Field of Search ..... 439/345, 346, 347, 324, 439/368, 372, 834, 835, 786, 787, 912

[56] References Cited

U.S. PATENT DOCUMENTS

| | | | |
|---|---|---|---|
| 1,149,599 | 8/1915 | Small | 439/712 |
| 2,158,002 | 5/1939 | Douglas | 173/334 |
| 3,327,282 | 6/1967 | Kroiak | 339/63 |
| 3,328,746 | 6/1967 | Schumacher | 339/94 |
| 3,711,813 | 1/1973 | Bryant | 439/345 |
| 3,732,522 | 5/1973 | Hartwell et al. | 339/19 |
| 4,227,762 | 10/1980 | Scheiner | 439/347 |
| 4,544,220 | 10/1985 | Aiello et al. | 339/59 M |
| 4,640,562 | 2/1987 | Shoemaker | 339/17 F |
| 4,647,131 | 3/1987 | Van Woensel | 439/372 |
| 4,702,542 | 10/1987 | Noyes | 439/347 |
| 4,708,662 | 11/1987 | Klein | 439/353 |
| 4,709,976 | 12/1987 | Nakama et al. | 439/350 |
| 4,799,896 | 6/1989 | Gaynor et al. | 439/232 |
| 4,878,853 | 11/1989 | Yamade et al. | 439/372 |
| 4,891,016 | 1/1990 | Luzzi et al. | 439/183 |
| 4,995,826 | 2/1991 | Schieferly | 439/347 |
| 5,145,356 | 9/1992 | Minnis | 439/352 |

FOREIGN PATENT DOCUMENTS

| | | | |
|---|---|---|---|
| 0286200 | 2/1967 | Australia | 439/345 |

*Primary Examiner*—Larry I. Schwartz
*Assistant Examiner*—Hien D. Vu
*Attorney, Agent, or Firm*—Michael, Best & Friedrich

[57] ABSTRACT

An electrical connector assembly includes a terminal block having a plurality of spaced contact pins mounted thereon and oriented in a first direction. A plurality of openings are formed in the terminal block and each is aligned with one of the contact pins. A plurality of sockets are each mounted at the end of a lead wire and are constructed and arranged to be received in any one of the openings for electrically engaging the contact pin aligned therewith. A locking bar has a plurality of locking portions and is pivotally mounted on the terminal block for movement between an unlocking position and a locking position wherein the locking portions are respectively aligned with one of the openings. A biasing spring engages the locking bar for biasing the locking bar toward its locking position. An end portion of the socket is constructed to engage the locking bar upon being inserted into one of the openings and to move the bar against the biasing spring and away from its locked position until the socket is fully engaged with the contact pin. Each of the sockets has a groove positioned to be engaged by the respective locking portion on the locking bar when the socket is in electrical engagement with said contact pin and a cylindrical portion is formed on the socket for frictionally engaging the margins of the openings as the socket is being inserted or removed from the terminal block for frictionally resisting movement of the socket through the opening.

18 Claims, 2 Drawing Sheets

TERMINAL ASSEMBLY

BACKGROUND OF THE INVENTION

This invention relates to cable connectors, and particularly to cable connectors for patient monitoring equipment.

Biopotential signals are normally transmitted by means of a plurality of lead wires from a patient to monitoring or diagnostic apparatus. Each leadwire is connected at one end to a patient electrode and at the other ends to a terminal connector. A cable couples the terminal connector to the signal processing apparatus which processes the signals in the performance of the monitoring or diagnostic function.

One type of prior art cable connector used for this purpose frictionally retained the ends of the individual leads in the terminal connector. This method of lead retention was not always satisfactory because improper coupling or patient movement often resulted in the leads becoming dislodged so that the patient data could not be processed.

Another type of prior art cable connector employed positive locking bars for retaining the patient leads in position. These did not permit connection or removal of the leads without actuation of the locking bar.

SUMMARY OF THE INVENTION

It is an object of the invention to provide a new and improved cable connector for transmitting electrical signals from sampling electrode to signal processing apparatus.

Another object of the invention is to provide cable connectors for transmitting electrical signals from an electrode to signal processing apparatus and which permits the automatic insertion of the connecting leads.

A further object of the invention is to provide a terminal connector for a patient monitoring or diagnostic apparatus which securely retains the individual patient leads but which releases the leads upon the application of sufficient withdrawal force.

Yet another object of the invention is to provide a terminal connector for a patient monitoring or diagnostic apparatus which positively retains patient leads in position but which does not require separate release of a locking bar when individual electrodes are being coupled.

These and other objects and advantages of the present invention will become more apparent from the detailed description of the preferred embodiment taken with the accompanying drawings.

In general terms, the invention comprises an electrical connector assembly including a terminal block having a plurality of spaced contact means mounted thereon and oriented in a first direction, a plurality of openings formed in the terminal block and each being aligned with one of the contact means and a plurality of leads each having socket means constructed and arranged to be received in any one of the openings for electrically engaging the contact means aligned therewith. Locking means has a plurality of locking portions and is pivotally mounted on the terminal block for movement between an unlocking position and a locking position wherein the locking portions are respectively aligned with one of the openings. Biasing means is provided for biasing the locking means toward its locking position and a first portion on the socket means is constructed and arranged for engaging the locking means and pivoting the same against the biasing means and away from its locked position when the socket means is inserted into one of the openings until the socket means is fully engaged with the contact means. Each of the socket means also has engageable portion formed thereon and positioned to be engaged by the respective locking portion on the locking means when the socket means is in electrical engagement with the pin means, and a third portion formed on the socket means for frictionally engaging the margins of the openings as the socket means is being inserted and removed from the terminal block for frictionally resisting movement of the socket means therethrough.

DETAILED DESCRIPTION OF THE PREFERRED EMBODIMENT

Figure 1:
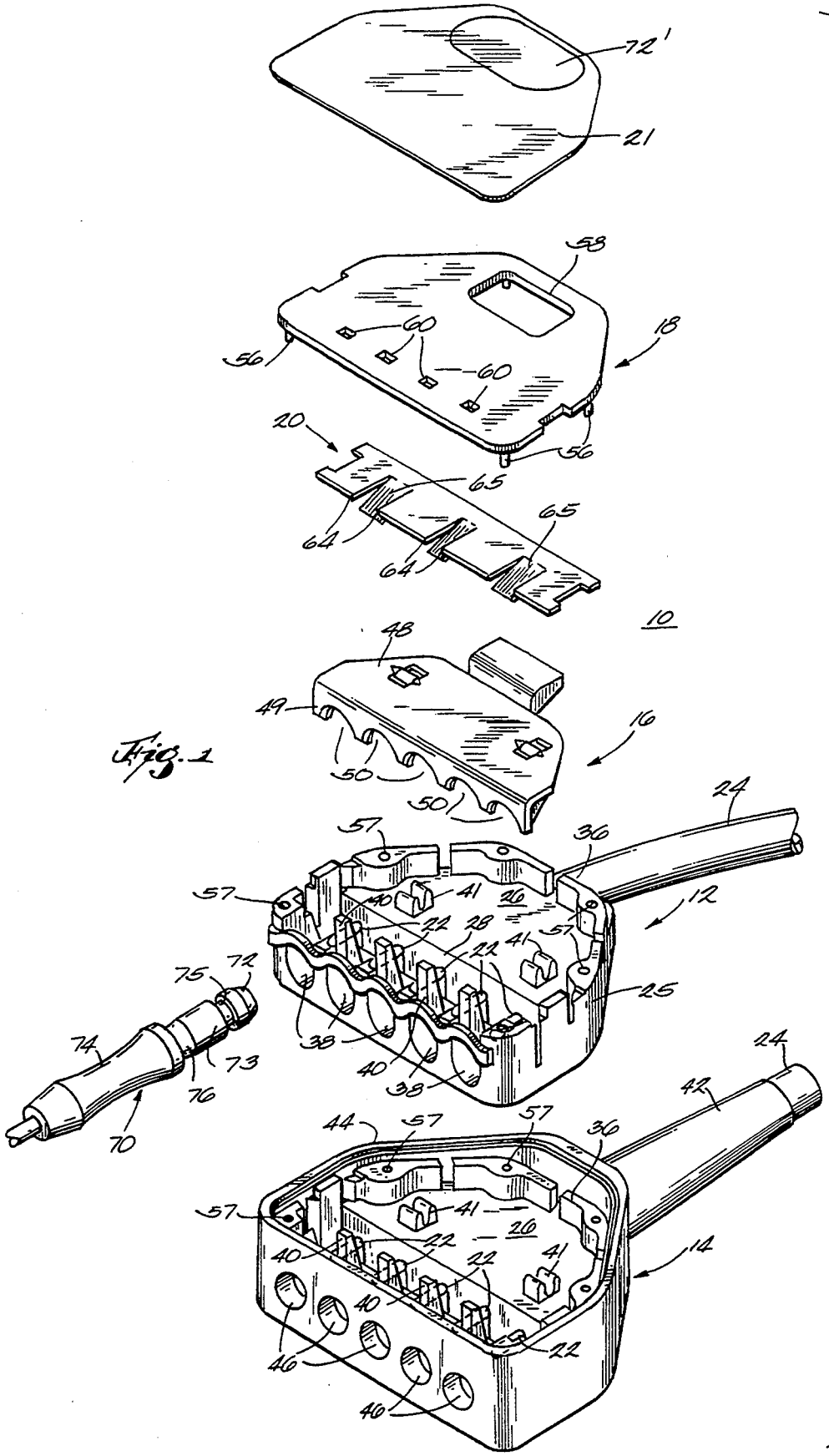
FIG. 1 is an exploded view of the terminal assembly according to the preferred embodiment of the invention.

The terminal block assembly 10 according to the preferred embodiment of the invention is shown in FIG. 1 to include an internal block 12, a shell 14 which is overmolded in a surrounding relation onto the block 12, a positive locking bar 16 which is pivotally mounted on the block 12, a cover plate 18 which is mounted on the open upper end of the shell 14 and a spring 20 disposed between the locking bar 16 and the cover 18 for biasing the bar 16 into a locked position as will be more fully described below. An embossed label 21 is fixed to the upper surface of the cover 18.

Figure 2:
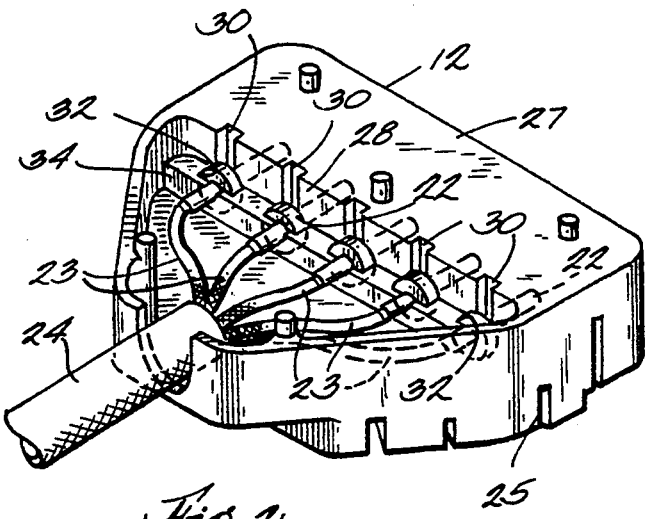
FIG. 2 is a bottom perspective view of a portion of the terminal block illustrated in FIG. 1.

The internal block 12 is molded of a suitable insulating material, such as glass. With reference to FIGS. 1 and 2, the block 12 includes a plurality of terminals 22 secured to the block 12 and each is connected by internal conductors 23 to a cable 24. The block 12 also includes a generally vertical extending outer wall 25, a horizontally extending upper wall 26 which extends horizontally from the rear wall to about the mid point of the block. In front of the block 12 there is a bottom wall 27 which is generally parallel to the upper wall 26 and extending for approximately the front half of the block. A vertically extending barrier wall 28 extends between the upper wall 26 and the bottom wall 27 and has a plurality of spaced apart, elongate openings 30 formed therein. The terminals 22 may be of the pin type and each extends through one of the openings 30 and are each connected to one of the individual conductors 23. Each terminal 22 also includes a laterally extending flange 32, each of which is received in and secured to a cradle 34 molded in the underside of top wall 26 at its junction with the barrier wall 28 (FIG. 2).

The sidewall 25 of block 12 extends upwardly from the upper surface of the wall 26 and terminates in an upper rim 36, all portions of which lie in a common plane generally parallel to the wall 26. At the front of block 12 there are a plurality of circular openings 38, each of which is aligned with one of the openings 30 and the barrier wall 28. Located between the front portion of the wall 25 and the barrier wall 28 and generally between the openings 38 there are a plurality of tapered supports 40. A pair of spaced apart, aligned rocker supports 41 are integrally formed on the upper surface of wall 26.

The shell 14 may be formed of a soft, low durometer PVC material which closely surrounds the block 12 and generally conforms to its outer configuration. At the back of the shell 14 there is an integral stress relief cone 42 which surrounds the end of the cable 24 as it enters the block 12. The upper end 44 of the shell 14 is slightly higher than the upper rim 36 of the wall 25 of block 12. At the front of the shell 14 there are a plurality of openings 46 which are coaxially aligned with the openings 38 in the block 12 and have the same diameters.

Figure 3:
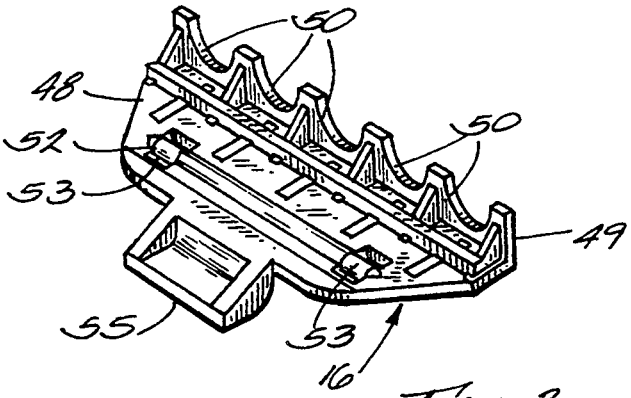
FIG. 3 is a bottom perspective view of another portion of the terminal block illustrated in FIG. 1.

The positive locking bar 16 is shown in FIGS. 1 and 3 to include a generally flat main body 48 and a front portion 49 which extends downwardly and has a plurality of semi-circular recesses 50 formed therein each of which defines a locking portion. A pivot pin 52 is fixed to the underside of bar 16 and extends across a pair of aligned rectangular openings 53 formed adjacent the bars opposite ends. The openings 53 are spaced apart the same distance as the rocker supports 41 and have the same center-to-center spacing. The rocker supports 41 are in turn sized to receive the pin 52. The centers of curvature of each of the recesses 50 are spaced apart the same distance as the openings 38 in block 12 so that when the bar 16 is in position with the pin 52 in the rocker supports 41, the recesses 50 are in front of the barrier wall 28 and in coaxial alignment with the openings 38 in block 12. For reasons which will be discussed more fully below, the edge of each of the recesses 50 are beveled outwardly. At the back of the bar 16 there is a handle 55 which extends generally upwardly and outwardly.

The cover plate 18 is configured to be received within the margins of the upper end of the shell 14 and to be supported by the upper rim 36 of the terminal block 25. In addition, the top plate 18 has integral, downwardly extending pins 56 adapted to be received within corresponding holes 57 formed in the wall 25. A window 58 is formed in top plate 18 in a position to be disposed above the handle 55 when the top plate is in position. In addition, there are a plurality of generally rectangular openings 60 for receiving the upper ends of the tapered support posts 40.

The spring 20 is formed of a generally flat spring steel material and has a plurality of slits 64 formed on its front edge. This defines a plurality of flaps 65 which are bent downwardly at a slight angle. When the terminal block 10 is assembled, the spring 20 is positioned between the locking bar 16 and the cover 18. As a result, the main portion of the spring 20 is engaged by the underside of the cover 18 while the lower edges of the flaps 65 engage the rocking bar 16 between the rocker supports 41 and the barrier wall 28. This results in the locking bar 16 being biased counterclockwise as viewed in FIG. 1 into a locking position with its downwardly extending front portion 49 positioned in front of the barrier wall 28 and the recesses 50 aligned with the openings 38.

The label 21 formed of a plastic material, such as lexan, and is applied to the upper surface of the cover 18 and has a transparent window 72' which is flexible. This permits the handle 55 and bar 16 to be engaged and depressed when the operator's finger is pressed downwardly on the flexible window 72. Instructions (not shown) may be printed on the label 71

The patient lead is shown in FIG. 1 to comprise a socket or plug 70 having internal contacts (not shown) which are well known in the art for engaging the pin terminals 22. The socket 70 may be formed of any suitable, flexible, electrically insulating material and is molded to include a frusto-conical nose portion 72, a cylindrical portion 73, and an elongate body portion 74. The socket is apertured at its nose end for receiving the pin terminals 22. Between the nose section 72 and the cylindrical section 73 there is a first annular groove 75 and a second annular grove 76 is formed between the cylindrical section 73 and the body section 74. While the terminal 22 is shown to be a pin, it will be understood by those skilled in the art that terminal 22 may also be a socket and a pin electrode projecting from the end of member 70.

The portions and grooves of the socket 70 are configured and proportioned such that when the socket is positioned in the aligned openings 38 and 46 and in contact with one of the terminals 22, the first groove 75 is in alignment with the recesses 50 in the locking bar 16 and the cylindrical portion 73 is disposed between the recesses 50 in the bar 16 and the inside surface of the outer wall 25 and the groove 76 is disposed in the openings 38, 46. Moreover, the curvature of the groove 75 is complimentary to that of the recesses 50 and the outside diameter of the cylindrical section 73 is sized to be received with a snug fit as it passes through the openings 38, 46. The body section 74 may be configured in a conventional manner so as to facilitate gripping.

In operation, when the socket 70 is inserted into the holes 38,46 the frusto-conical nose portion 72 will engage the beveled surface on one of the recesses 50, thereby rocking the locking bar 16 clockwise as viewed in FIG. 1. Further displacement of the socket 70 will move the cylindrical portion 73 through the openings 38,46 until the entire cylindrical section is disposed within the block 12 and the groove 76 occupies the opening 38,46. As the cylindrical section passes fully through the opening, there will be a snap as the groove 76 seats into position. Because of the relative diameters of the cylindrical section 73 and the opening 38,46, insertion will be against the frictional drag of the components. Also, as the groove 76 seats within the openings 38,46, the socket 70 fully engages the pin terminals 22 and the groove 75 is aligned with the recesses 50. This will permit the locking bar 16 to pivot downwardly into its locking position so that the periphery of the aligned recess 50 can move downwardly into engagement with the groove 75, thereby providing a positive lock.

In a similar manner, from one to five sockets 70 may be similarly connected and locked into position. Because each of the sockets is maintained both by the positive locking bar 16 and the resistance to movement of the cylindrical section 73 through the openings 38,46, a substantial degree of force is required to remove the socket from the terminal block 12. This insures that the socket 70 cannot be easily dislodged. However, if sufficient force is applied, the edge of the groove 75 can be made to pivot the locking bar 16 against the spring 20 so that the socket can be pulled free. Moreover, the socket 70 can be moved into position and locked by the bar 16 without the operator being required to actuate any pushbuttons or the like. Insertion and removal of a socket 70 is facilitated by engaging the handle 55 of the bar 16 through the window 58. With the bar thus pivoted, the socket 70 can be removed with considerably less force than when the locking bar 16 is seated in position.

While only a single embodiment of the invention has been illustrated and described, it is not intended to be limited thereby but only by the appended claims.

It is claimed:

1. An electrical connector assembly including:

a terminal block having a plurality of spaced first terminal means mounted thereon and oriented generally parallel, a plurality of openings formed in said terminal block and each opening being aligned with one of the first terminal means and being defined by a margin, a plurality of second terminal means each being mounted on a lead and constructed and arranged to be received in any one of said openings for electrically engaging one of the first terminal means aligned therewith, locking means having a plurality of locking portions and being mounted on the terminal block for movement between an unlocking position and a locking position wherein the locking portions are respectively aligned with one of said openings for being engaged by any one of said second terminal means, biasing means for biasing said locking means toward said locking position, said second terminal means also having a first portion for engaging said locking means and for moving the same against said biasing means and away from said locking position until said second terminal means is fully engaged with said first terminal means or fully removed from said terminal block as said second terminal means is moved into and out of engagement with first terminal means, each of said second terminal means having a second portion formed thereon and positioned to be engaged by one of the locking portions on said locking means when said second terminal means is in electrical engagement with said first terminal means, and a third portion formed on said second terminal means for frictionally engaging the margin of one of the openings as the second terminal means is being inserted or removed from said terminal block for frictionally resisting movement of the second terminal means through said opening.

2. The electrical connector assembly as set forth in claim 1 wherein said locking means is pivotally mounted on said terminal block for movement of said locking portions toward and away from alignment with said openings, said biasing means urging said locking means for pivotal movement toward its locking position.

3. The electrical connector assembly as set forth in claim 2 wherein said locking portions comprise a plurality of arcuate recesses formed in said locking means, with each of said recesses being aligned with one of said openings when said locking means is in its locking position.

4. The electrical connector assembly as set forth in claim 3 wherein said first terminal means comprises pin electrodes and said second terminal means comprise socket means having an end receivable within said openings, said first portion being formed on said end and being tapered for engaging the locking portion for pivoting said locking means out of its locking position to permit insertion of said socket means, the second portion means on said socket means comprising a groove formed therein and adjacent said first portion to permit said locking means to return to its locking position when said socket means is fully engaged with the respective pin electrode means.

5. The electrical connector assembly as set forth in claim 4 wherein said locking means is mounted for pivotal movement on the terminal block about a pivot axis, said locking portions being disposed on one side of said axis, and handle means disposed on the other side of said axis and engageable for pivoting said locking means against said biasing means for moving said locking portions out of engagement with the second portions of said socket means to facilitate the removal of said socket means from said terminal block.

6. The electrical connector assembly as set forth in claim 5 wherein the third portion of the socket means is generally cylindrical and disposed adjacent said second portion and on the opposite side thereof relative to said first portion, said cylindrical portion being sized to be received within said openings with a relatively snug fit.

7. The electrical connector assembly as set forth in claim 1 wherein said locking portions comprise a plurality of arcuate recesses formed in said locking means, with each of said recesses being aligned with one of said openings when said locking means is in its locking position.

8. The electrical connector assembly as set forth in claim 1 wherein said second terminal means has an end receivable within said openings, said first portion means being formed on said end and being tapered for engaging a locking portion for pivoting said locking means out of its locked position to permit insertion of said second terminal means, the second portion on said second terminal means comprising a groove formed therein and adjacent said first portion to permit said locking means to return to its locking position when said socket means is fully engaged with the respective first terminal means.

9. The electrical connector assembly as set forth in claim 1 wherein said locking means is mounted for pivotal movement on the terminal block about a pivot axis, said locking portions being disposed on one side of said axis, and handle means disposed on the other side of said axis and engageable for pivoting said locking means against said biasing means for moving said locking portions out of engagement with the second portions of said second terminal means to facilitate the removal of said second terminal means from said terminal block.

10. The electrical connector assembly as set forth in claim 1 wherein the third portion of the second terminal means is generally cylindrical and disposed adjacent said second portion and on the opposite side thereof relative to said first portion, said cylindrical portion being sized to be received within said openings with a relatively snug fit.

11. An electrical connector assembly for cooperating with a plurality of socket means adapted to couple with pin electrodes, said connector assembly including a terminal block having a plurality of spaced contact pin means mounted thereon and oriented generally parallel, a plurality of openings formed in said terminal block and each being aligned with one of the pin means, locking bar means pivotally mounted on the terminal block and having locking portions respectively aligned with one of said openings when the locking bar means is in a locking position wherein the locking portions are disposed between said openings and said contact pin means, the locking portions being constructed and arranged to engage a socket means disposed in one of said openings when the locking bar means is in its locking position, and biasing means for biasing said locking means toward its locking position.

12. The electrical connector set forth in claim 11 wherein said locking portions comprise a plurality of arcuate recesses formed in said locking means, with each of said recesses being aligned with one of said openings when said locking means is in its locking position.

13. The electrical connector assembly as set forth in claim 12 wherein said locking means is mounted for pivotal movement on the terminal block about a pivot axis, said locking portions being disposed on one side of said axis, and handle means disposed on the other side of said axis and engageable for pivoting said locking means against said biasing means for moving said locking portions out of their locking positions to facilitate the removal of socket means from said terminal block.

14. The electrical connector assembly as set forth in claim 13 wherein said locking portions comprise a plurality of arcuate recesses formed in said locking means, with each of said recesses being aligned with one of said openings when said locking means is in its locking position.

15. The electrical connector assembly as set forth in claim 14 wherein said plug means has an end receivable within said openings, said first portion being formed on said end and being tapered for engaging the locking portion for pivoting said locking means out of its locking position to permit insertion of said plug means, the second engageable means on said plug means comprising a groove formed therein and adjacent said second portion to permit said locking means to return to its locking position when said plug means is fully engaged with the respective first contact means.

16. The electrical connector assembly as set forth in claim 15 wherein said locking means is mounted for pivotal movement on the terminal block about a pivot axis, said locking portions being disposed on one side of said axis, and handle means disposed on the other side of said axis and engageable for pivoting said locking means against said biasing means for moving said locking portions out of engagement with the second portions of said plug means to facilitate the removal of said plug means from said terminal block.

17. The electrical connector assembly as set forth in claim 16 wherein the third portion of the plug means is generally cylindrical and disposed adjacent said first portion and on the opposite side thereof relative to said second portion, said cylindrical portion being sized to be received within said openings with a relatively snug fit.

18. An electrical connector assembly including:

a terminal block having a plurality of spaced first contact means mounted thereon and oriented in a first direction, a plurality of openings formed in said terminal block and each being aligned with one of the first contact means, each opening being defined by a margin; a plurality of leads each having plug means constructed and arranged to be received in any one of said openings and having a second contact means for electrically engaging the first contact means aligned therewith, locking means pivotally mounted on the terminal block and having a plurality of engageable locking portions respectively aligned with one of said openings for being engaged by any one of said plug means which is inserted into said openings, biasing means for biasing said locking means toward a locking position, said plug having a first portion means for engaging said locking means and for pivoting said locking means against said biasing means and away from its locking position until said plug means is fully engaged with said first contact means, each of said plug means also having a second portion formed thereon and positioned to be engaged by one of the respective locking portion on said locking means when said plug means is in electrical engagement with said pin means and a third portion for frictionally engaging the margins of the openings as the plug means is being inserted or removed from said terminal block for frictionally resisting movement of the plug means through said opening.

* * * * *